US010159372B2

(12) United States Patent
Heath

(10) Patent No.: US 10,159,372 B2
(45) **Date of Patent: *Dec. 25, 2018**

(54) PLATFORM FOR WORK WHILE STANDING

(71) Applicant: Company of Motion, LLC, Santa Barbara, CA (US)

(72) Inventor: Joel Ward Heath, Santa Barbara, CA (US)

(73) Assignee: Company of Motion, LLC, Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/280,853

(22) Filed: Sep. 29, 2016

(65) Prior Publication Data

US 2017/0079456 A1 Mar. 23, 2017

Related U.S. Application Data

(63) Continuation-in-part of application No. 14/554,522, filed on Nov. 26, 2014, now Pat. No. 9,457,226.
(Continued)

(51) Int. Cl.
*A47G 27/02* (2006.01)
*A63B 21/068* (2006.01)
(Continued)

(52) U.S. Cl.
CPC ..... *A47G 27/0231* (2013.01); *A63B 21/068* (2013.01); *A63B 22/18* (2013.01);
(Continued)

(58) Field of Classification Search
CPC A47G 27/0231; A63B 21/068; A63B 26/003; A63B 22/18; A63B 2208/0233;
(Continued)

(56) References Cited

U.S. PATENT DOCUMENTS

D134,341 S 11/1942 Churchill
3,352,559 A 11/1967 Larsen
(Continued)

FOREIGN PATENT DOCUMENTS

DE 101 34 688 A1 2/2003
DE 20 2012 005792 U1 7/2012
(Continued)

OTHER PUBLICATIONS

Fluid Stance by Company of Motion dated 2015. Found online [Aug. 6, 2015] http://www.fluidstance.com/product/.
(Continued)

*Primary Examiner* — Nathan L Van Sell
(74) *Attorney, Agent, or Firm* — Knobbe, Martens, Olson & Bear LLP

(57) ABSTRACT

A work platform has a top member with a surface sized to receive a user's feet thereon while standing and a bottom member coupled to the top member. The bottom member has a width and length generally equal to the width and length of the top member. The bottom member has a curved surface generally at the longitudinal center of the work platform defined at least partially by a radius of curvature of between about 100 mm and about 850 mm. The curved surface induces instability under a user standing on the top member to thereby facilitate active muscle engagement in the user's legs while standing on the work platform.

14 Claims, 9 Drawing Sheets

Related U.S. Application Data

(60) Provisional application No. 62/008,955, filed on Jun. 6, 2014, provisional application No. 62/277,269, filed on Jan. 11, 2016.

(51) Int. Cl.

| | |
|---|---|
| ***A63B 26/00*** | (2006.01) |
| ***A63B 22/18*** | (2006.01) |
| ***A63B 23/08*** | (2006.01) |
| ***A63B 23/00*** | (2006.01) |

(52) U.S. Cl.

CPC ..... *A63B 26/003* (2013.01); *A63B 23/085* (2013.01); *A63B 2023/006* (2013.01); *A63B 2208/0204* (2013.01); *A63B 2208/0233* (2013.01); *A63B 2225/62* (2013.01); *Y10T 428/24008* (2015.01); *Y10T 428/24661* (2015.01)

(58) Field of Classification Search

CPC ..... A63B 2208/0204; A63B 23/085; A63B 2225/62; A63B 2023/006; Y10T 428/24661; Y10T 428/24008

See application file for complete search history.

(56) References Cited

U.S. PATENT DOCUMENTS

| | | | |
|---|---|---|---|
| 3,586,321 | A | 6/1971 | Gehrke et al. |
| 3,630,540 | A | 12/1971 | Smith |
| D265,411 | S | 7/1982 | Hedenblad |
| 4,491,318 | A | 1/1985 | Francke |
| 4,653,748 | A | 3/1987 | Seel et al. |
| 4,705,272 | A | 11/1987 | Rupprecht |
| 4,817,950 | A | 4/1989 | Goo |
| 4,826,159 | A | 5/1989 | Hersey |
| 5,048,823 | A | 9/1991 | Bean |
| D341,406 | S | 11/1993 | Scheurer |
| 5,292,296 | A | 3/1994 | Davignon |
| 5,545,115 | A | 8/1996 | Corcoran |
| 5,584,787 | A | 12/1996 | Guidry |
| 5,603,334 | A | 2/1997 | Sharp |
| 5,643,164 | A | 7/1997 | Teff |
| 5,730,690 | A | 3/1998 | Guidry |
| D394,481 | S | 5/1998 | Delisse |
| 5,810,703 | A | 9/1998 | Stack |
| D405,135 | S | 2/1999 | Scott |
| 5,897,474 | A | 4/1999 | Romero |
| 6,019,712 | A | 2/2000 | Duncan |
| 6,422,983 | B1 | 7/2002 | Weck |
| D467,632 | S | 12/2002 | Berns |
| D469,486 | S | 1/2003 | Olson |
| D471,605 | S | 3/2003 | Teff |
| 6,543,769 | B1 | 4/2003 | Podoloff et al. |
| 6,554,753 | B1 | 4/2003 | Weck et al. |
| 6,575,885 | B1 | 6/2003 | Weck et al. |
| 6,616,583 | B1 | 9/2003 | Stack |
| D482,164 | S | 11/2003 | Millhollin |
| 6,705,977 | B1 | 3/2004 | Ziak |
| D501,111 | S | 1/2005 | Lan |
| D502,970 | S | 3/2005 | Maakestad |
| D505,985 | S | 6/2005 | Carbonero |
| 6,916,276 | B1 | 7/2005 | Robinson |
| D508,097 | S | 8/2005 | Perez |
| 6,945,920 | B1 | 9/2005 | Kemery et al. |
| 7,011,612 | B2 | 3/2006 | Repking |
| 7,094,183 | B2 | 8/2006 | Hsieh |
| 7,137,938 | B2 | 11/2006 | Gottlieb |
| 7,264,580 | B2 | 9/2007 | Lu |
| 7,300,392 | B1 | 11/2007 | Curran |
| D557,347 | S | 12/2007 | Nishimoto |
| D564,604 | S | 3/2008 | Mikail |
| 7,344,488 | B2 | 3/2008 | Weck et al. |
| 7,357,767 | B2 | 4/2008 | Tsai |
| 7,374,517 | B2 | 5/2008 | Lockett |
| D572,776 | S | 7/2008 | Wells |
| D585,098 | S | 1/2009 | Rauwerdink |
| 7,479,097 | B2 | 1/2009 | Rosborough et al. |
| 7,488,177 | B2 | 2/2009 | Pearson |
| 7,494,446 | B2 | 2/2009 | Weck et al. |
| D587,774 | S | 3/2009 | Giannatos |
| D588,224 | S | 3/2009 | Giannatos |
| D588,225 | S | 3/2009 | Giannatos |
| D604,374 | S | 11/2009 | Bizzell |
| 7,632,218 | B2 | 12/2009 | Sannes et al. |
| 7,666,126 | B2 | 2/2010 | Rempe |
| 7,670,265 | B1 | 3/2010 | Forrest et al. |
| 7,686,396 | B2 | 3/2010 | Schaaf |
| 7,806,807 | B2 | 10/2010 | Genua |
| 7,811,217 | B2 | 10/2010 | Odien |
| 7,815,548 | B2 | 10/2010 | Barre et al. |
| D631,276 | S | 1/2011 | White |
| D635,615 | S | 4/2011 | Foster et al. |
| 7,976,034 | B1 | 7/2011 | Hong |
| D645,910 | S | 9/2011 | Foster et al. |
| 8,062,199 | B2 | 11/2011 | Smith |
| D658,420 | S | 5/2012 | Liang |
| D659,776 | S | 5/2012 | Zydiak |
| 8,360,943 | B2 | 1/2013 | Smith |
| 8,444,532 | B1 | 5/2013 | Barcena |
| D695,367 | S | 12/2013 | Lovegrove et al. |
| 8,734,308 | B1 | 5/2014 | Joslin |
| D724,163 | S | 3/2015 | Kelley |
| D728,935 | S | 5/2015 | Huang |
| D731,200 | S | 6/2015 | Andersen |
| D740,381 | S | 10/2015 | Heath |
| D750,183 | S | 2/2016 | Heath |
| D776,769 | S | 1/2017 | Heath |
| 2004/0014571 | A1 | 1/2004 | Haynes |
| 2007/0270296 | A1 | 11/2007 | Caldicott |
| 2008/0039304 | A1 | 2/2008 | Mattox |
| 2008/0280740 | A1 | 11/2008 | Knecht et al. |
| 2011/0143896 | A1 | 6/2011 | Senegal |
| 2013/0053228 | A1 | 2/2013 | Winegar |
| 2013/0172161 | A1 | 7/2013 | Lo |
| 2014/0228187 | A1 | 8/2014 | Moscarello |
| 2015/0018178 | A1* | 1/2015 | Carbone ..... A63B 71/0009 482/146 |
| 2015/0351573 | A1 | 12/2015 | Heath |

FOREIGN PATENT DOCUMENTS

| | | | |
|---|---|---|---|
| JP | S49-43252 | Y1 | 11/1974 |
| JP | S51-155963 | U | 12/1976 |
| KR | 10-2008-0071039 | A | 8/2008 |

OTHER PUBLICATIONS

Steppie balance board; How Steppie works, www.steppie.dk/how, accessible as of Oct. 13, 2014 via internet archive (http://web.archive.org/web/20141013051852/http://steppie.dk.how) (1 page).

International Search Report and Written Opinion dated Oct. 13, 2015 in PCT Application No. PCT/US2015/034286.

Extended European Search Report dated May 2, 2018 for European Patent Application No. 15803433.

* cited by examiner

PLATFORM FOR WORK WHILE STANDING

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application is a continuation-in-part application of U.S. application Ser. No. 14/554,522 filed Nov. 26, 2014, now U.S. Pat. No. 9,457,226, which claims the benefit of U.S. Provisional Application No. 62/008,955, filed Jun. 6, 2014, the entirety of both of which is incorporated by reference and should be considered a part of this specification. The present application also claims the benefit of U.S. Provisional Application No. 62/277,269 filed Jan. 11, 2016, the entire contents of which are incorporated by reference and should be considered a part of this specification.

BACKGROUND

Field

The present invention is directed to a work platform, and more particularly to various embodiments of work platforms that provide a subtle instability underfoot of those who work standing up to promote active muscle engagement while maintaining productivity.

Description of the Related Art

The negative health impact of prolonged sitting including the increased risk of suffering heart attacks have been documented in recent years. Many systems have been developed to help workers remain active in the workplace, where prolonged sitting is prevalent, including stand-up desks and desks incorporating treadmills. However, these can be bulky and complex and so not well suited for individuals with limited workspace. They can also be expensive and out of reach of many consumers' budgets.

However, simply spending more time standing up while at work, which is promoted by stand-up desks, does not solve the problem since the posture is still sedentary, just vertical. Additionally, sedentary standing postures, such as on padded mats, can lead to problems with the user's joints. Further, users of height adjustable desks tend to give up standing after a while of using such height adjustable desks, either because the novelty wears away or due to the pain or monotony experienced with sedentary standing poses, such that adjustable height desks alone do not lead to increased standing periods at the workplace over the long run.

SUMMARY

Accordingly, there is a need for devices and systems that can be used while standing, such as at a stand-up desk and indeed all standing jobs (e.g., check-out counters, cash registers, security details, factory lines) and that promote motion and active muscle engagement while maintaining productivity. Various embodiments are described below for work platforms that provide such a benefit. The embodiments disclosed herein achieve the following objectives: how to maximize multi-axial motion of a user while at a standing work station, how to reduce the keystroke error rate while working at a computer while using the work platform, and how to impart motion while not taxing the calf muscles and Achilles tendon to allow users to use the work platform for extended periods of time (e.g., while at the workplace). An additional advantage and benefit of the work platform embodiments disclosed herein is that the work platform enables and facilitates users to stand more (e.g., while at a standing workstation, such as a standup desk) by making standing more comfortable and enjoyable. Additionally, the work platform embodiments described herein allow users to improve circulation in their legs while seated by using the work platform as a foot stool (e.g., while seated at their desks).

In accordance with one aspect of the present invention, a work platform is provided. The work platform comprises a generally planar top member having a surface sized to receive a user's feet thereon while standing. The work platform also comprises a bottom member disposed below and coupled to the top member, the bottom member having a width and length generally equal to or larger than a width and length of the top member. The bottom member has a bottom surface with a curved surface generally at a longitudinal center of the work platform defined at least partially by a radius of curvature of between about 100 mm and about 850 mm. The curved surface is configured to induce instability under a user standing on the top member to thereby facilitate active muscle engagement in the user's legs while standing on the work platform.

In accordance with another aspect, a work platform is provided. The work platform comprises a monolithic top member having a surface sized to receive a user's feet thereon while standing. The work platform also comprises a monolithic bottom member disposed below and operably coupled to the top member. The bottom member has a width and length that circumscribes a width and length of the top member. The bottom member has a bottom surface with a curved surface generally at a longitudinal center of the work platform defined at least partially by a radius of curvature, the bottom member having one or more openings therein. The curved surface is configured to induce instability under a user standing on the top member to thereby facilitate active muscle engagement in the user's legs while standing on the work platform.

In accordance with another aspect, a kit for a modular work platform is provided. The kit comprises one or more components chosen from the group consisting of: one or more interchangeable monolithic top members having a surface sized to receive a user's feet thereon while standing; one or more interchangeable monolithic bottom members operably coupleable to the top member, the bottom member having a width and length generally equal to or larger than a width and length of the top member. The bottom member has a curved surface generally at a longitudinal center of the work platform defined by a radius of curvature, where the curved surface is configured to induce instability under a user standing on the top member to thereby facilitate active muscle engagement in the user's legs while standing on the work platform; one or more interchangeable bumpers coupleable to one or both of the top member and the bottom member; one or more mats that can be placed under the work platform during use to inhibit damage to the support surface and the work platform; and one or more adjustment members coupleable to the work platform to adjust one or more of a height, a radius of curvature or a tipping angle of the work platform. The work platform is selectively customizable by a user with said one or more components.

DETAILED DESCRIPTION

Figure 1:
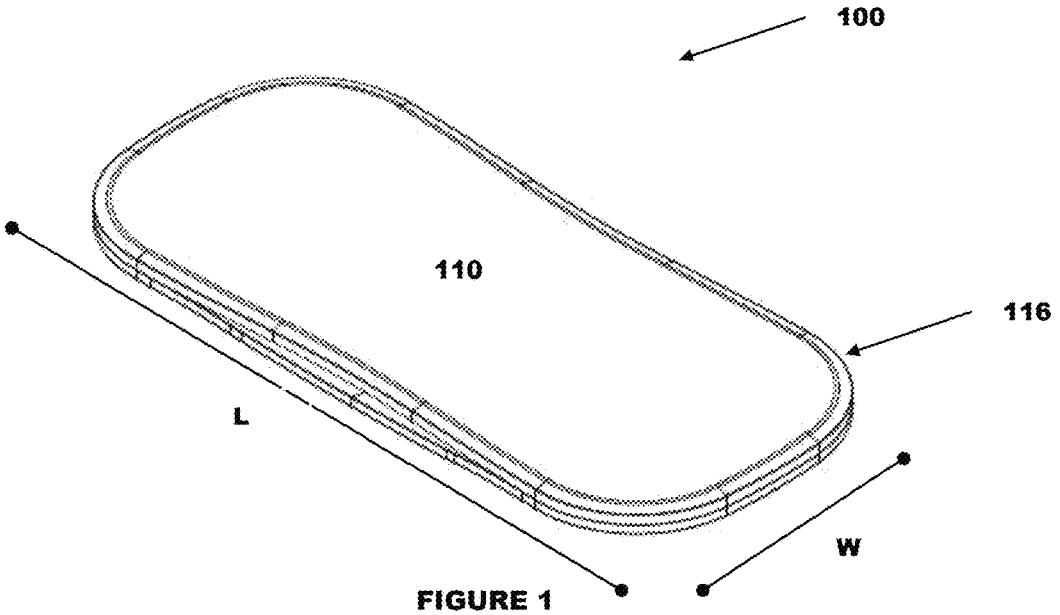
FIG. 1 is a top perspective view of an embodiment of a work platform.
Figure 2:
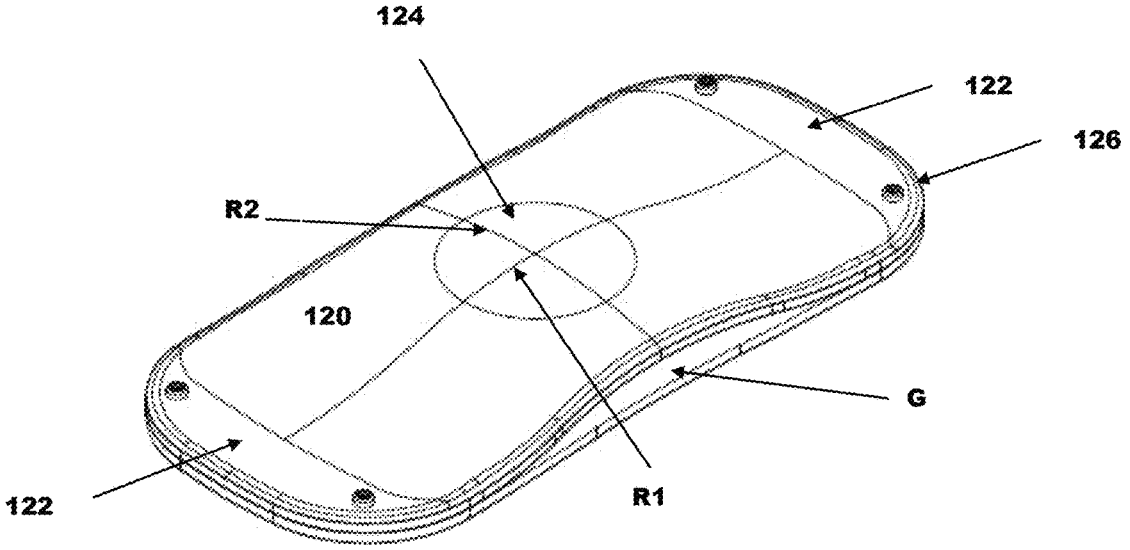
FIG. 2 is a bottom perspective view of the work platform of FIG. 1.
Figure 3:
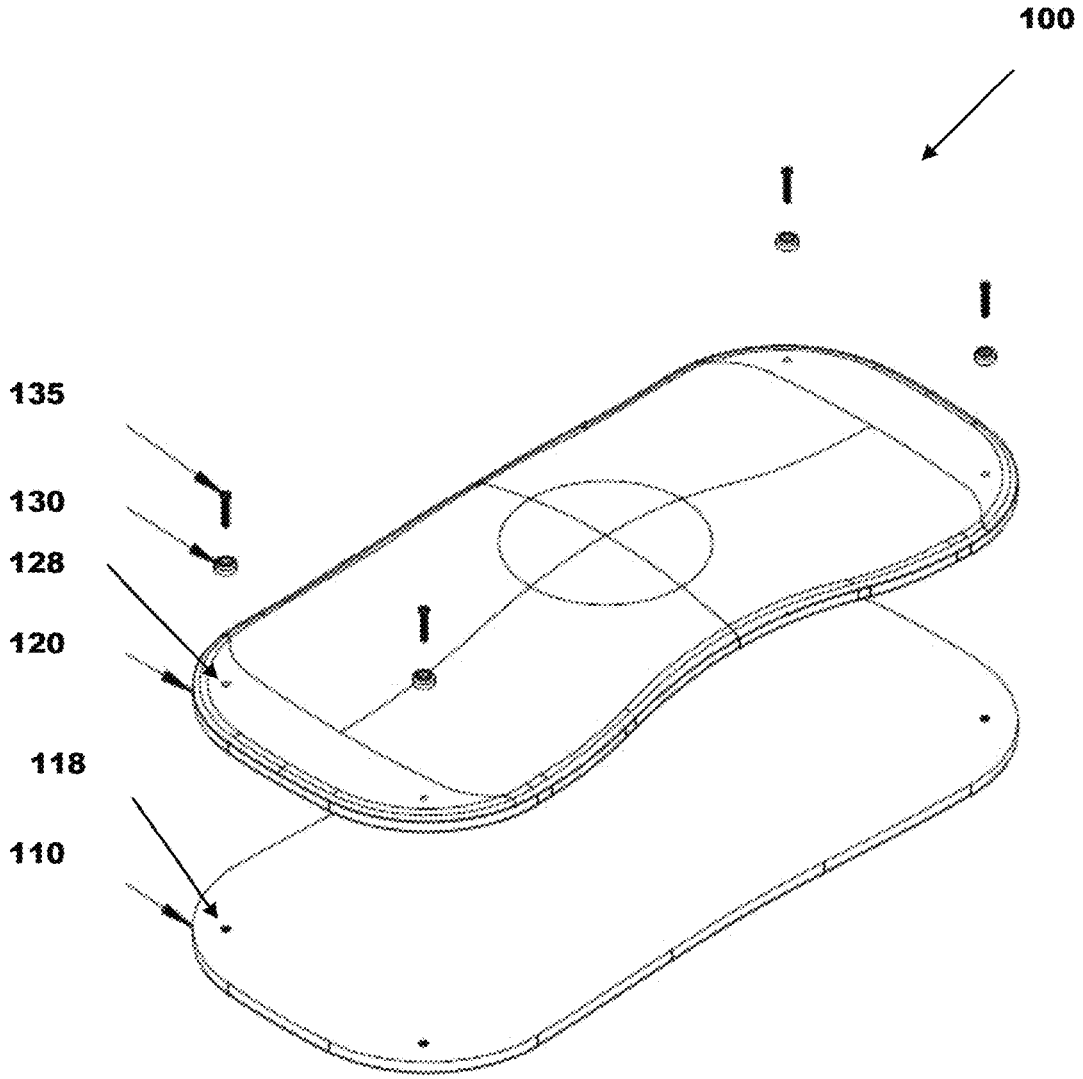
FIG. 3 is a bottom exploded view of the work platform of FIG. 1.

FIGS. 1-3 show one embodiment of a work platform 100. The platform 100 can have a top member 110 and a bottom member 120. The top member 110 can be interchangeable can be made of a variety of materials (e.g., wood, metal, plastic, other polymer materials, such as ethylene vinyl acetate (EVA), composites) or a combination of materials. In the illustrated embodiment, the top member 110 is made of wood. In one embodiment, the top surface of the top member 110 is planar (e.g., substantially flat) and can be a single piece (e.g., monolithic). The user can rest their feet on the top member 110 during use of the platform 100 (e.g., feet spaced apart, such as hip width apart).

The bottom member 120 can be a single piece (e.g., monolithic piece). In the illustrated embodiment, the bottom member 120 is made of wood. However, in other embodiments, the bottom member 120 can be made of other suitable materials, such as molded plastic, metal, such as aluminum, other polymer material, a composite material, a combination of different materials, etc. The bottom member 120 can extend from a generally planar surface on its left and right ends 122 to a curved surface 124 (e.g., bulb portion) generally at the center (e.g., at the longitudinal center, at the lateral (widthwise) center, at both the longitudinal and widthwise center) of the bottom member 120. In the illustrated embodiment, the top and bottom members 110, 120 are separate components that are attached to each other. In other embodiments, the top and bottom members 110, 120 can be a single piece (monolithic), such that the work platform 100 is a single piece.

The curved surface 124 can optionally be a spherical surface (e.g., a radius of curvature R1 in a longitudinal direction of the work platform 100 is the same as a radius of curvature R2 in a widthwise direction of the work platform 100). For example, where the curved surface 124 is a spherical surface, the radii of curvature R1, R2 can both be the same and have a length between about 100 mm and about 800 mm, such as 450 mm. In another embodiment, the radius of curvature R1 in the longitudinal direction of the work platform 100 is greater than the radius of curvature R2 in the widthwise direction of the work platform 100. In still another embodiment, the radius of curvature R1 in the longitudinal direction of the work platform 100 is smaller than the radius of curvature R2 in the widthwise direction of the work platform 100. In one embodiment, the curved surface is at least partially defined by a radius of curvature R1 of between about 100 mm and about 850 mm. However, the radius R1 can have other suitable values.

Figure 4:
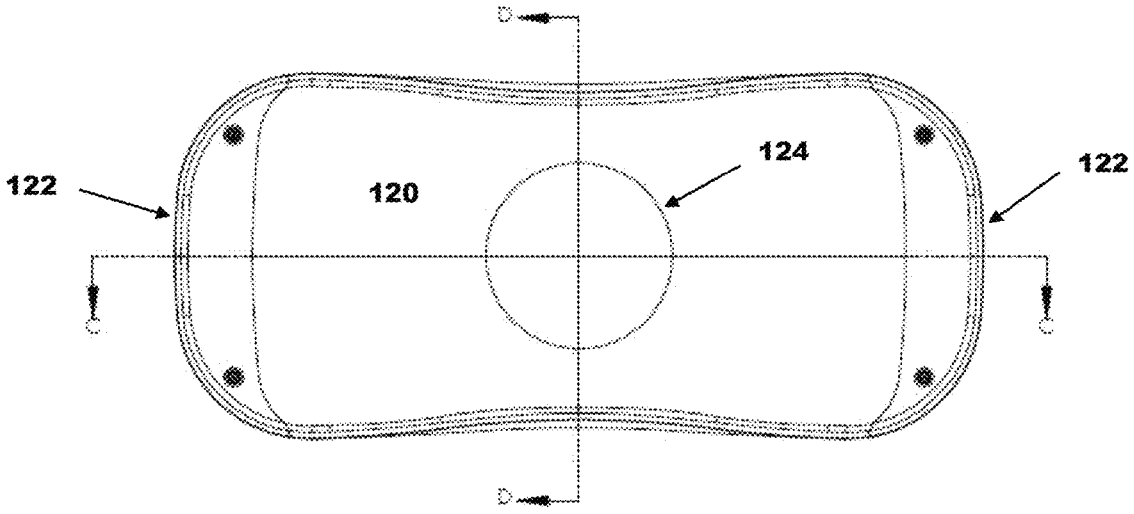
FIG. 4 is a bottom planar view of the work platform of FIG. 1.
Figure 5:
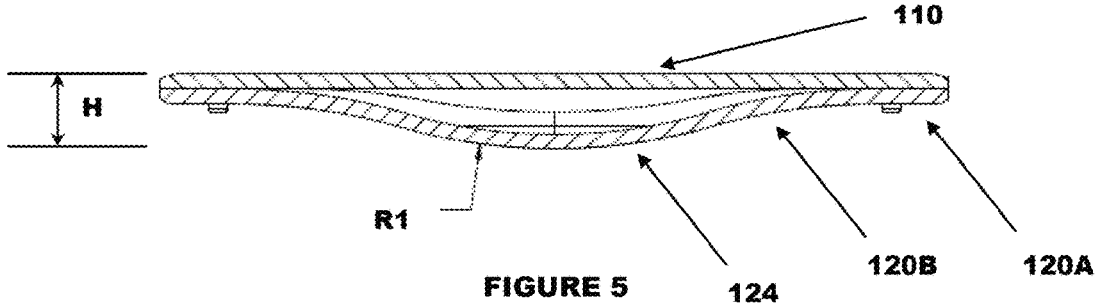
FIG. 5 is a cross-sectional view of the work platform of FIG. 4 along line C-C.
Figure 6:
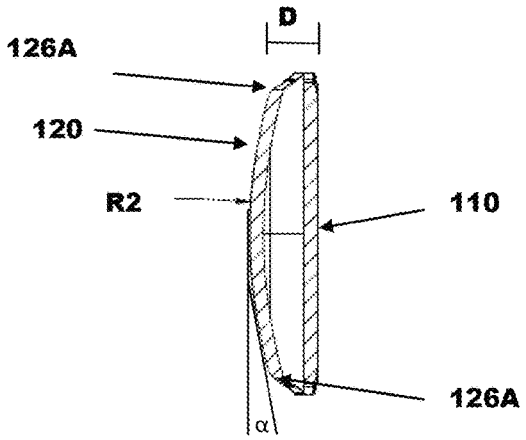
FIG. 6 is a cross-sectional view of the work platform of FIG. 4 along line D-D.
Figure 7:
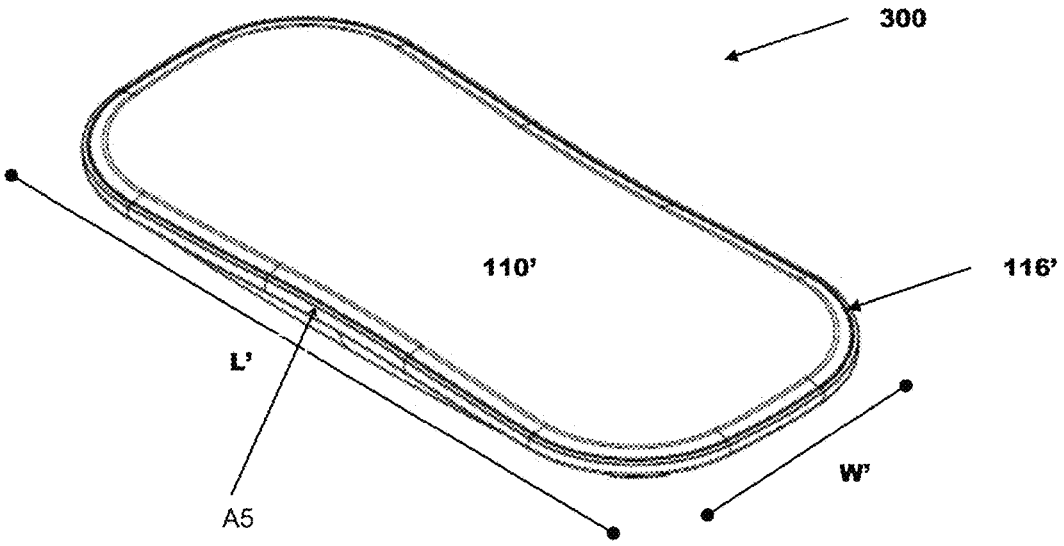
FIG. 7 is a top perspective view of an embodiment of a work platform.

With reference to FIGS. 4-6, the bottom member 120 can have a surface that is generally planar (e.g., flat) 120A at the left and right ends 122 and convex at the curved surface 124 (e.g., bulb), with an intermediate concave section 120B. The tip angle in the longitudinal direction of the work platform 100 (e.g., angle spanned when tip the board from a balanced position to a position where one of the ends 122 touches the ground surface) can optionally be about 10 degrees. However, in other embodiments, the tip angle in the longitudinal direction can have other values.

As shown in FIG. 6, the bottom member 120 extends in the widthwise direction of the work platform from the curved surface 124 (e.g., bulb) to side edges 126A of the bottom member 120. In the illustrated embodiment, the side edges 126A are spaced from the top member 110 by a distance D so that an angle of the bottom member 120 at said side edges 126A relative to a plane tangent to the center of the curved surface 124 (e.g., bulb) generally defines an angle $\alpha$ (e.g., acute angle), so as to limit the motion (e.g., rocking motion) of the work platform 100 in the widthwise direction (e.g., limit the angular travel or heel-to-toe or tip angle that the user experiences while standing on the work platform with their feet generally perpendicular to the longitudinal axis of the work platform 100). In one embodiment, the angle $\alpha$ can be less than 15 degrees (e.g., about 10 degrees, about 5 degrees, about 13 degrees, etc.) to advantageously inhibit or limit overstretching of the calf muscles during use, particularly where the user will spend considerable time (e.g., more than 1 hour, more than 4 hours, more than 5 hours) on the work platform 100 during use. In other embodiments, the angle $\alpha$ can be greater than 15 degrees, such as about 30 degrees, optionally achieved by decreasing the distance D, to provide for increased stretching of the calf muscles during use.

In some embodiments, the radius of curvature R1 in the longitudinal direction of the work platform 100 can be about ½ as much as the radius of curvature R2 in the widthwise direction, which can advantageously inhibit (e.g., prevent) or limit overstretching of the user's calf muscles while the user stands on top of the work platform 100 (e.g., during their work shift, work day, etc.). For example, the radius of curvature R1 can be about 400 mm and the radius of curvature R2 can be about 800 mm. However, in other embodiments, the radius of curvature R1 in the longitudinal direction of the work platform 100 can vary in other ways (e.g., can be about $\frac{1}{3}^{rd}$, $\frac{1}{4}^{th}$, $\frac{1}{8}^{th}$, etc.) relative to the radius of curvature R2 in the widthwise direction. In still another embodiment, the work platform can curve in the longitudinal direction (e.g., as defined by radius of curvature R1) but not curve in the widthwise direction.

In the illustrated embodiment, the bottom member 120 curves so as to define a gap G between the top member 110 and the bottom member 120. In one embodiment, the bottom member 120 can at least partially flex while the user stands on the work platform 100. In some embodiments, said flexion can be facilitated by said gap G. In some embodiments, said flexion can be varied (e.g., by inserting a cushion or bumper or air bladder between the top and bottom members 110, 120, such as within the gap G generally at the center of the work platform 100 and/or at the longitudinal ends 122).

In one embodiment the platform 100 can have a length L of between about 20 inches and about 30 inches, a width W of between about 9 inches and about 15 inches, and a height H (when placed on the ground) of between about 1 inch and about 3 inches. However, the platform 100 can have other suitable lengths L, widths W and/or heights H. In one embodiment the bottom member 120 can have a geometry (e.g., length and width) that mirrors and is generally equal to the geometry of the top member 110. As shown, for example, in FIG. 2, the bottom member 120 can have a rim 126 that is co-extensive with the outer rim 116 of the top member 110.

With continued reference to FIGS. 2-3, the platform 100 can include one or more bushings or bumpers 130 disposed generally at the corners (e.g., longitudinal ends 122) of the platform 100. The bushings or bumpers 130 can contact the underside of the bottom member 120 and can be fastened to the bottom member 120 by fasteners 135 that extend through openings 128 in the bottom member 120 and at least partially into openings 118 in the top member 110.

FIG. 7-12 show another embodiment of a work platform 300 that is similar to the work platform 100 in FIGS. 1-6 (e.g., can be made of the same materials discussed above), except as discussed below. The work platform 300 can include a top member 110' (e.g., a single piece or monolithic top member 110'), and can have a length L' and width W' similar to (e.g., identical to) the length L and width W of the work platform 100. In one embodiment the platform 300 can have a length L' of between about 20 inches and about 30 inches, a width W' of between about 9 inches and about 15 inches, and a height H' (when placed on the ground) of between about 1 inch and about 3 inches. The length L' of the work platform 300 advantageously allows the user to assume a shoulder width stance while standing on the platform 300 (i.e., the user can space their feet apart approximately the width of their shoulders), which allows the user to use a comfortable stance while on the platform. The width W' of the platform 300 can vary as shown on FIG. 10, being wider at the ends and narrower at the center. The width W' of the platform 300 advantageously accommodates users of various shoe sizes (e.g., up to size 12 shoes) so that the user's feet are completely on the work platform 300 during use. In this manner, the tilting of the work platform 300 is not limited by the user's feet, but provided by the edge of the bottom member of the work platform 300, as discussed further below.

The work platform 300 can also have a bottom member 220 (e.g., a single piece or monolithic bottom member 220) with a length and width that generally corresponds to (e.g., is co-extensive with) the length and width of the top member 110'. In the illustrated embodiment, the bottom member 220 has a rim 226 that circumscribes the periphery of the top member 110'. The bottom member 220 can in one embodiment be made of aluminum. However, the bottom member 220 can be made of other suitable metals. In other embodiments, the bottom member 220 can be made of a plastic material, a composite material, a wood or wood composite material, or a combination of different materials. The bottom member 220 can have a curved surface 224 (e.g., bulb) located generally at the longitudinal center of the work platform 300. The curved surface 224 (e.g., bulb) can in one embodiment be defined at least in part by a spherical surface. In one embodiment, the curved surface 224 can have a radius of curvature R1' along the longitudinal direction that is similar to (e.g., identical to) the radius of curvature R1 for the curved surface 124 of the work platform 100. The curved surface 224 can also have a radius of curvature R2' along the widthwise direction that is similar to (e.g., identical to) the radius of curvature R2 for the curved surface 124 of the work platform 100. For example, where the curved surface 224 is a spherical surface, the radii of curvature R1', R2' can both be the same and have a length between about 100 mm and about 800 mm, such as 450 mm.

Figure 10:
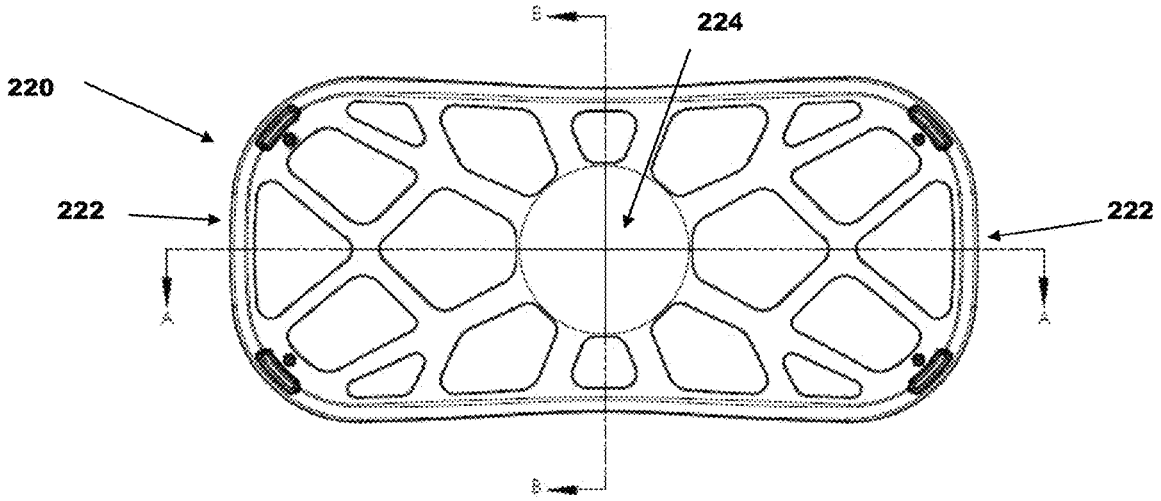
FIG. 10 is a bottom planar view of the work platform of FIG. 7.
Figure 11:
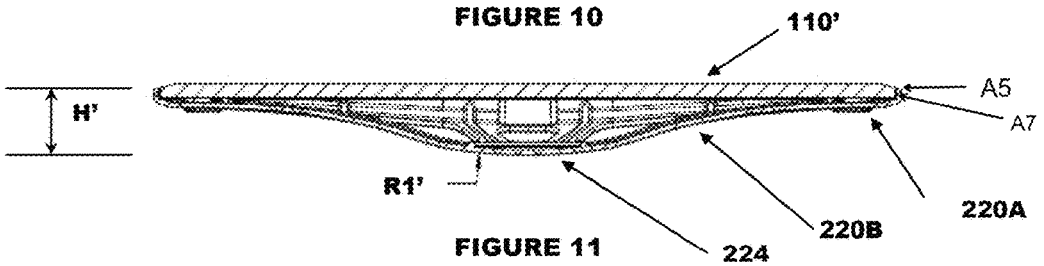
FIG. 11 is a cross-sectional view of the work platform of FIG. 10 along line A-A.

With reference to FIGS. 10-12, the bottom member 220 can have a surface that is generally planar (e.g., flat) 220A at the left and right ends 222 and convex at the curved surface 224 (e.g., bulb), with an intermediate concave section 220B. The tip angle in the longitudinal direction of the work platform 300 (e.g., angle spanned when tip the board from a balanced position to a position where one of the ends 222 touches the ground surface) can optionally be about 10 degrees. However, in other embodiments, the tip angle in the longitudinal direction can have other values.

Figure 12A:
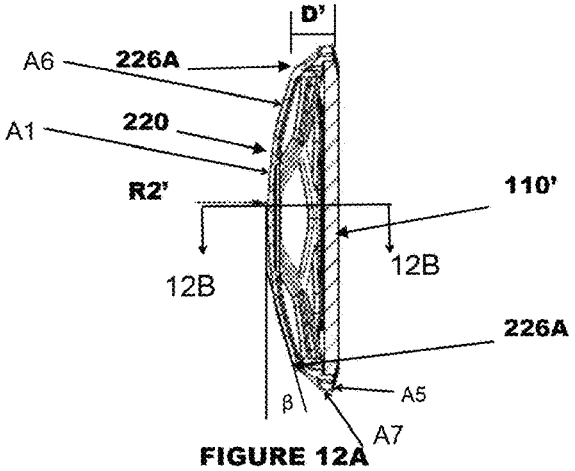
FIG. 12A is a cross-sectional view of the work platform of FIG. 10 along line B-B.
Figure 12B:
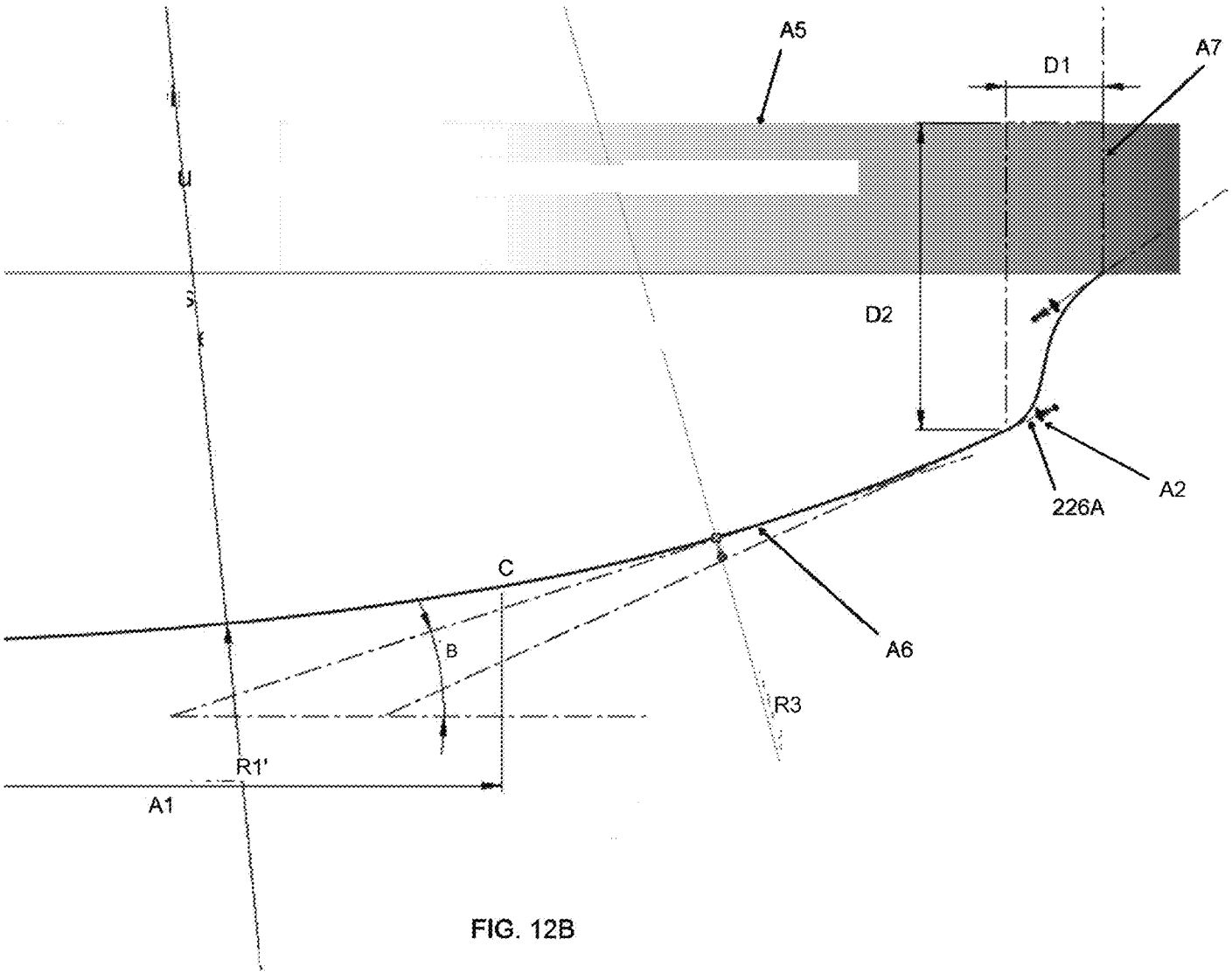
FIG. 12B is a schematic partial view of the curvature of the bottom member of the work platform in FIG. 12A taken along line 12B-12B at a plane that crosses the platform perpendicularly at the longitudinal center of the platform.

As shown in FIG. 12A, the bottom member 220 extends in the widthwise direction of the work platform from the curved surface 224 (e.g., bulb) to side edges 226A of the bottom member 220. In the illustrated embodiment, the side edges 226A are spaced from the top member 110' by a distance D' so that an angle of the bottom member 220 at said side edges 226A relative to a plane tangent to the center of the curved surface 224 (e.g., bulb) generally defines an angle β (e.g., acute angle), so as to limit the motion (e.g., rocking motion) of the work platform 300 in the widthwise direction (e.g., limit the angular travel or heel-to-toe or tip angle that the user experiences while standing on the work platform with their feet generally transverse to the longitudinal axis of the work platform 300). In one embodiment, the angle β can be less than 15 degrees (e.g., about 10 degrees, about 5 degrees, about 13 degrees, etc.) to advantageously inhibit or limit overstretching of the calf muscles during use, particularly where the user will spend considerable time (e.g., more than 1 hour, more than 4 hours, more than 5 hours) on the work platform 300 during use. In other embodiments, the angle β can be greater than 15 degrees, such as about 30 degrees, optionally achieved by decreasing the distance D', to provide for increased stretching of the calf muscles during use.

As discussed above, the angle β in FIG. 12A (or angle B in FIG. 12B) can be less than 15 degrees, which advantageously allows the user to experience the same range of ankle mobility and lower leg mobility experienced during normal walking, thereby allowing the user to comfortably use the work platform 300 (e.g., during extended periods of time while at a standing workstation, such as at a stand up desk, at a check-out counter, etc.). This results in health benefits, including improved posture, additional circulation and a raised heart rate (e.g., approximately 15% higher, or an increase of about 12 beats per minute, on average compared to the heart rate while sitting). Additionally, the work platform 300 is designed to allow multi-axial movement by the user, allowing for increased mobility while standing comfortably on the work platform 300. For example, the work platform 300 (and platform 100) allows the user to comfortably pivot (e.g., tilt in any direction, such as along the length of the work platform, along the width of the work platform or at any angular position in between) or rotate (or swivel) about the vertical axis of the platform 300, while standing on the work platform 300, thereby allowing the user to engage their hip flexor and oblique muscles.

Advantageously, the angle of 15 degrees or less, as discussed above, does not result in a therapeutic stretch of the Achilles tendon and calf muscles, as the objective of the work platform is to provide a subtle instability under the user's feet that allows the user to experience a range of mobility when tilting in the heel-to-toe direction consistent with the range of mobility experienced during normal walking, not a strenuous exercise provided by other products where the user is not meant to use the product for extended periods of time (such as during the work day, as discussed herein). Such a therapeutic stretch has been found to require tilt angles of greater than 20 degrees.

In one embodiment, the radius of curvature R1' in the longitudinal direction of the work platform 300 is the same as a radius of curvature R2' in the widthwise direction of the work platform 300, so that they define a spherical surface, as discussed above. In another embodiment, the radius of curvature R1' in the longitudinal direction of the work platform 300 is greater than the radius of curvature R2' in the widthwise direction of the work platform 300. In still another embodiment, the radius of curvature R1' in the longitudinal direction of the work platform 300 is smaller than the radius of curvature R2' in the widthwise direction of the work platform 300. In one embodiment, the curved surface 224 is at least partially defined by a radius of curvature R1' of between about 100 mm and about 850 mm. However, the radius R1' can have other suitable values.

In some embodiments, the radius of curvature R1' in the longitudinal direction of the work platform 300 can about ½ as much as the radius of curvature R2' in the widthwise direction, which can advantageously inhibit (e.g., prevent) overstretching of the user's calf muscles while the user stands on top of the work platform 300 (e.g., during their work shift, work day, etc.). For example, the radius of curvature R1' can be about 400 mm and the radius of curvature R2' can be about 800 mm. However, in other embodiments, the radius of curvature R1' in the longitudinal direction of the work platform 300 can vary in other ways (e.g., can be about $1/3^{rd}$, $1/4^{th}$, $1/8^{th}$, etc.) relative to the radius of curvature R2' in the widthwise direction. In still another embodiment, the work platform can curve in the longitudinal direction (e.g., as defined by radius of curvature R1') but not curve in the widthwise direction.

Figure 8:
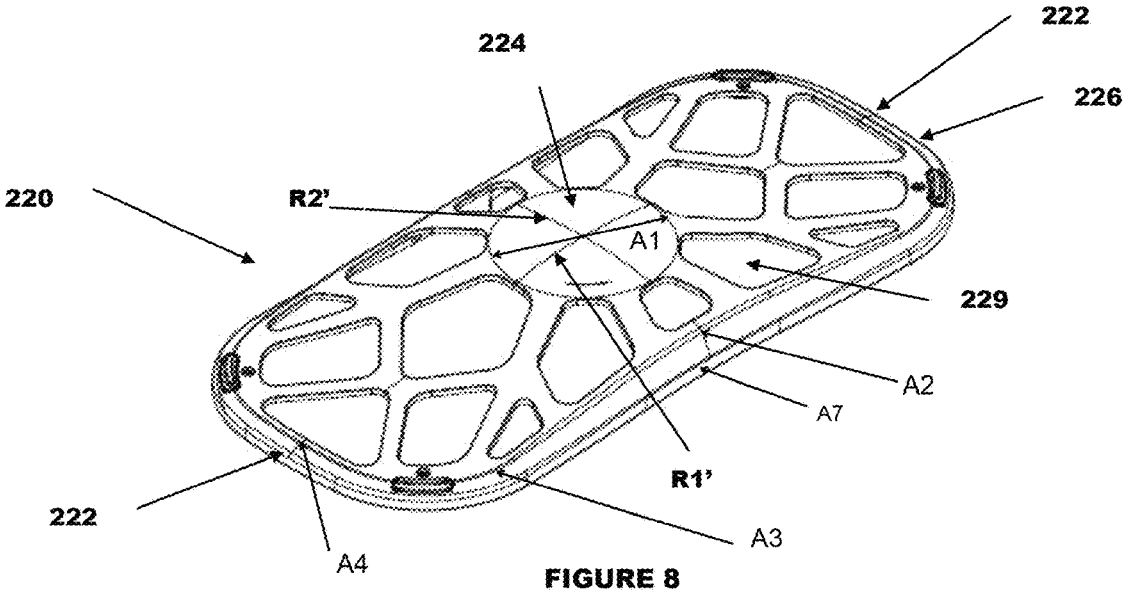
FIG. 8 is a bottom perspective view of the work platform of FIG. 7.
Figure 9:
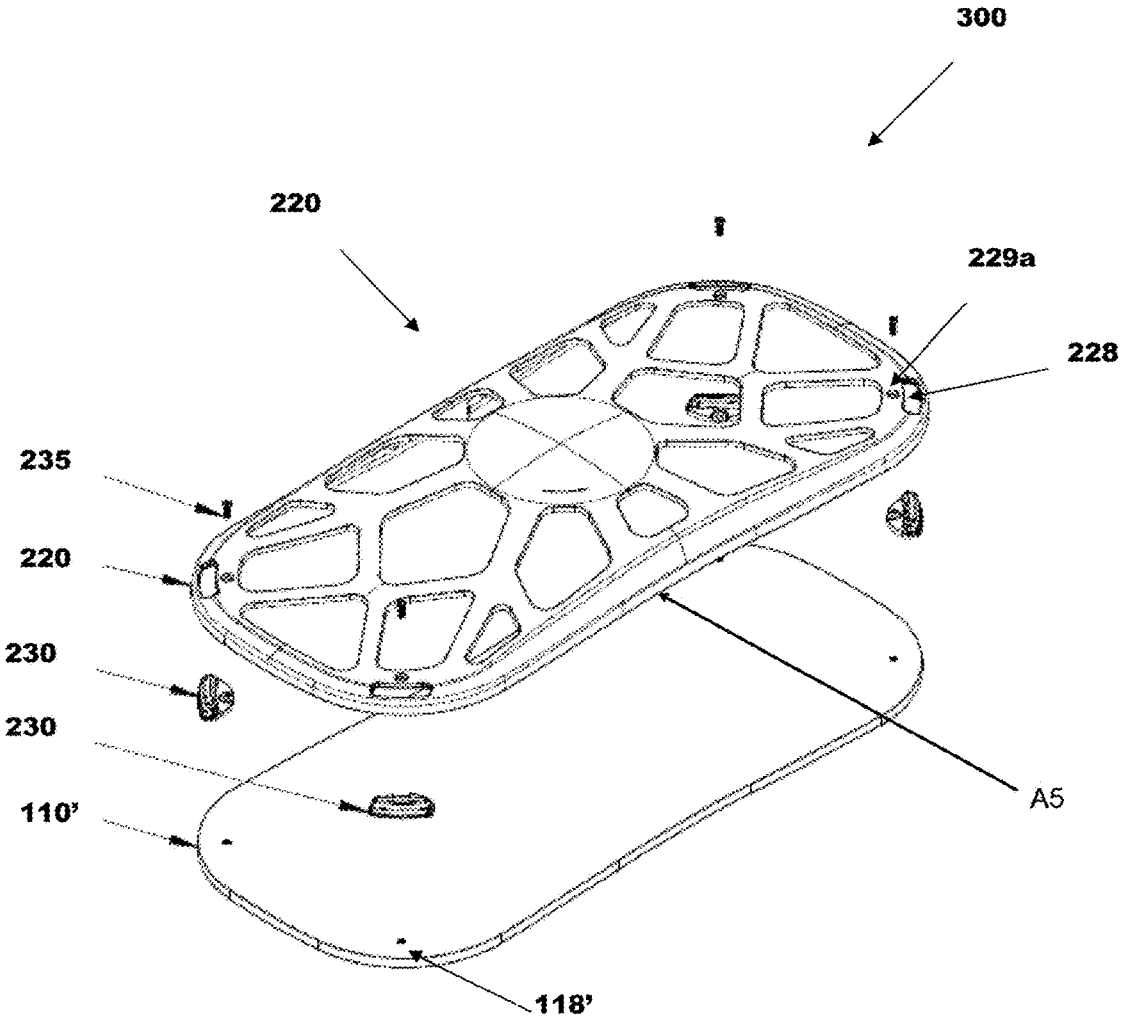
FIG. 9 is a bottom exploded view of the work platform of FIG. 7.

With continued reference to FIGS. 8-9, the bottom member 220 can have one or more cutouts or openings 229 therein (e.g., to reduce the weight of the work platform 300). The bottom member 220 optionally has apertures 228 generally at the corners, as well as fastener openings 229 at the corners of the bottom member 220. In the illustrated embodiment, the work platform 300 optionally includes bumpers 230 that are interposed between the top and bottom members 110', 220 generally at the corners of the work platform 330, where at least a portion of the bumpers 230 extend through the apertures 228. Fasteners 235 can extend through the openings 229*a*, 118' to fasten the bottom member 220 to the top member 110' and thereby fasten the bumpers 230 between the top and bottom members 110', 220. In the illustrated embodiment, the top and bottom members 110', 220 are directly fastened to each other, at least via the fasteners 235. Optionally, in another embodiment the top member 110' can move (e.g., float) relative to the bottom member 220 via the bumpers 230. In still another embodiment, bumpers can be disposed between the top and bottom members 110', 220 along the edges, such as near edges 226A along line B-B in FIG. 10.

With continued reference to FIGS. 7-12B, the bulb 224 of the bottom member 220 can have a chord A1 or diameter of between about 5 inches and about 8 inches. In some embodiments, the chord or diameter A1 can be about 6 inches. The chord A1 defines an active circle over which the bottom member 220 primarily touches the support surface (e.g., floor) during use of the work platform 300. The side edges 226A, which are defined on the bottom member 220, advantageously limit the tilting of the bottom member 220 (i.e., the side edges 226A provide the maximum tilt in the transverse or heel-to-toe direction), and thereby limit the tilting of the work platform 300 in the heel-to-toe direction. Importantly, the tilting of the work platform 300 is defined by the bottom member 220, not by the top platform 110' (e.g., by the top platform 110' bottoming out against the floor or other support surface). If the tilt limiting edges were defined by the top platform 110', a user with larger feet could hit the floor (e.g., with their toes or heels) while tilting the platform to maximum tilt, resulting in potential injury to the user's feet. By having the tilt limiting edges (side edges 226A) on the bottom member 220, the user's toes or heels remain off the floor and do not hit the floor when the work platform 300 is tilted to maximum tilt, inhibiting injury to the user's feet.

The side edge 226A at a location A2 midway along the length of the bottom member 220 (on both the front side and rear side of the work platform 300) is horizontally inward (laterally offset) from an outer edge A7 of the bottom member by an amount D1 of between about 7 mm and about 15 mm, more preferably about 12 mm. However, other values are possible. The side edge 226A at a location A2 is vertically offset from a top edge A5 of the bottom member 220 by an amount D2 of between about 30 mm and about 40 mm, in some embodiments about 35 mm. However, other values are possible. The side edge 226A has a maximum height D2 at location A2 and gradually decreases toward the ends of the platform 300. At location A3 (see FIG. 8), the side edge 226A can have a height (from outer edge A7) of between about 15 mm and about 25 mm, in some embodiments about 20 mm. The side edge 226A at location A4 can in some embodiments be the same as the height at location A3, though in other embodiments the height at location A4 can be shorter than at location A3 (e.g., 15 mm, 18 mm).

As discussed above, the radius R1' of the bulb portion 224 on the bottom member 220 can be between about 100 mm and 850 mm, in some embodiments about 450 mm. The bottom member 220 has a surface A6 between the outer edge of the bulb 224 and the side edge 226A defined by a radius of curvature R3 (e.g., between point C and A2 on FIG. 12B). The radius of curvature R3 can be shorter than the radius of curvature R1' of the bulb 224. In one embodiment, the radius of curvature R3 can be between about 200 mm and about 250 mm, in some embodiments about 235 mm. However, other values are possible. The bulb portion 224 and surface A6 provide a continuous and gradual curvature between the center of the bottom member 220 and the side edges 226A that allow for continuous movement of the work platform 300 (e.g., without and jerky movements) while the user tilts the work platform 300 in the heel-to-toe (e.g., transverse) direction (e.g., direction transverse to the longitudinal axis of the work platform 300).

As discussed above, the work platform 300 (and work platform 100) is designed to enable multi-axial mobility of the user while standing at work (e.g., while at a standing workstation, such as a standup desk, check-out counter, etc.) consistent with the range of ankle mobility experienced while walking (i.e., without taxing the Achilles tendon or calf muscles, or requiring users to fight to maintain their balance). The work platform 300 (and platform 100), in testing, provided an average ankle range of motion of about 24 degrees, similar to the ankle range of motion experienced by users while walking. The work platform 300 design disclosed herein advantageously allows such added mobility at the workplace while at the same time maintaining (if not improving) on the keystroke error rate users experience while working at a computer while sitting down. Of importance, the primary activity the work platform 300 is designed for is something other than just standing on the platform (i.e., more than just balancing on the platform). Rather, as discussed above, the primary activity the work platform 300 is designed for is to allow users to work productively while at a standing workstation (e.g., a standup desk with a computer, a check-out counter) while experiencing increased mobility (e.g., consistent with that experienced during normal walking), to thereby improve the overall productivity and health of the user (e.g., at the workplace, in the classroom).

In one embodiment, the bottom member 220 can be made in a sand cast process. In another embodiment, the bottom member 220 can be made in a die cast process, where the aluminum walls can be thinner than in the sand casted version of the bottom member 220. Further, the die cast version of the bottom member 220 can have an internal rib system. Accordingly, while the sand cast version and die cast version of the bottom member 220 can look similar in design, there are structural differences between the two versions.

During use, the user (e.g., person working at a desk, checkout counter, assembly line, security) would place their feet on the top member or board of the work platform 100, 300. With respect to the embodiments illustrated in FIGS. 1-6 and 7-12, the curved surface 124, 224 of the bottom member 120, 220 would provide a slight instability to the user, causing the user's muscles to actively engage while the user goes about their workday standing on the work platform 100, 300, thereby allowing the user to remain active while standing (e.g., at their desk, work station, etc.). Moreover, the curved surface 124, 224 of the work platform 100, 300 advantageously provides a continuous and gradual instability that allows the user to experience said subtle instability without jarring motions.

Figure 13A:
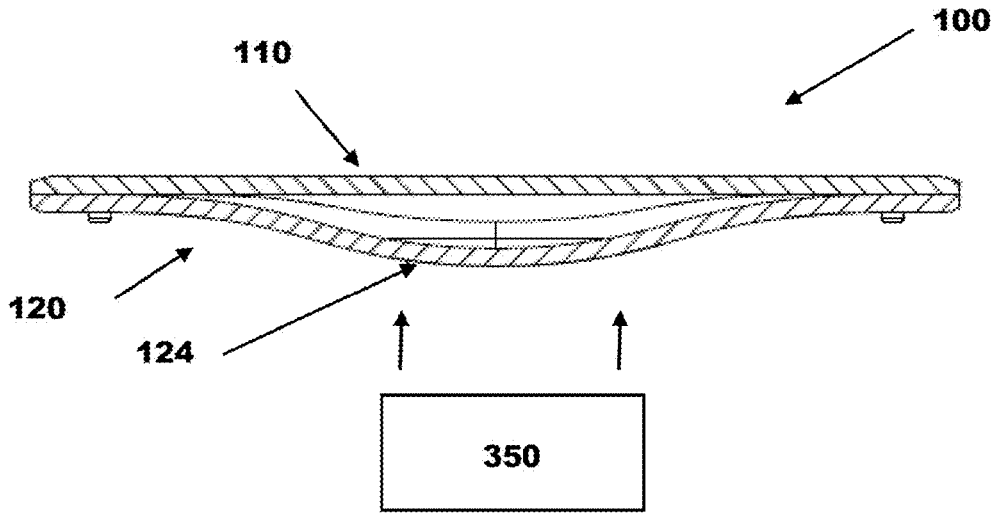
FIG. 13A is a cross-sectional side view of the work platform of FIG. 1 and schematic view of an adjustment member coupleable to the work platform of FIG. 1.

With reference to FIG. 13A, an adjustment member 350 can be attached or coupled (removably coupled) to the work platform 100. For example, the adjustment member 350 can couple to the bottom member 120 over the curved surface 124 (e.g., over the bulb). The adjustment member 350, once coupled to the work platform 100, can optionally provide an increased height H of the work platform 100. Optionally, the adjustment member 350 can provide a curved surface with a different radius of curvature than that of the curved surface 124, thereby adjusting the functionality of the work platform 100 (e.g., adjusting the tip angle in the width-wise direction). One or more different adjustment members 350 can be provided (e.g., in a kit, such as the kit 400 discussed below), where each adjustment member 350 provides a different performance adjustment (e.g., radius of curvature for the bottom member 120) for the work platform 100. Accordingly, a user can customize the operation of their work platform 100 at least in part with said adjustment member 350.

Figure 13B:
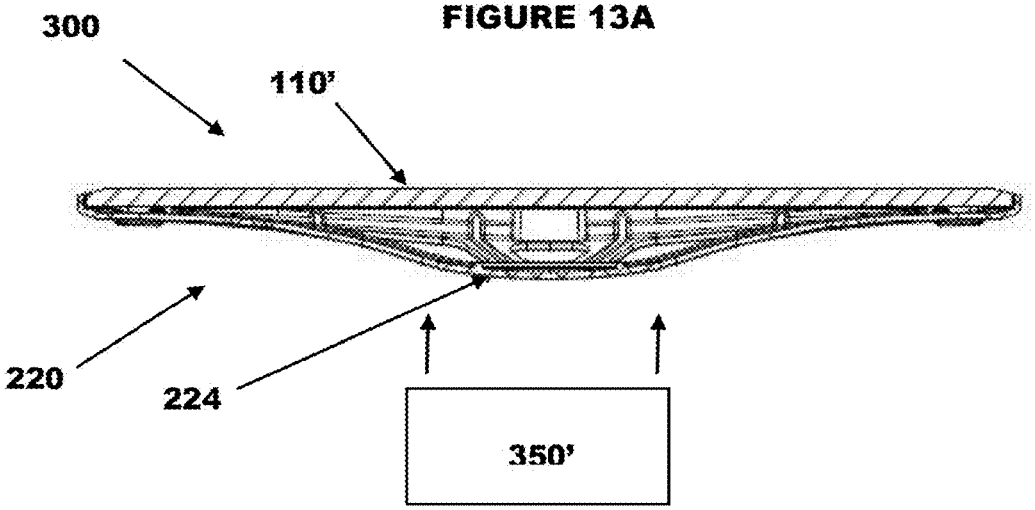
FIG. 13B is a cross-sectional side view of the work platform of FIG. 1 and schematic view of an adjustment member coupleable to the work platform of FIG. 1.

With reference to FIG. 13B, an adjustment member 350' can be attached or coupled (removably coupled) to the work platform 300. For example, the adjustment member 350' can couple to the bottom member 220 over the curved surface 224 (e.g., over the bulb). The adjustment member 350', once coupled to the work platform 300, can optionally provide an increased height H' of the work platform 300. Optionally, the adjustment member 350' can provide a curved surface with a different radius of curvature than that of the curved surface 224, thereby adjusting the functionality of the work platform 300 (e.g., adjusting the tip angle in the width-wise direction). One or more different adjustment members 350' can be provided (e.g., in a kit, such as the kit 400 discussed below), where each adjustment member 350 provides a different performance adjustment (e.g., radius of curvature for the bottom member 220) for the work platform 300. Accordingly, a user can customize the operation of their work platform 100 at least in part with said adjustment member 350.

Figure 14:
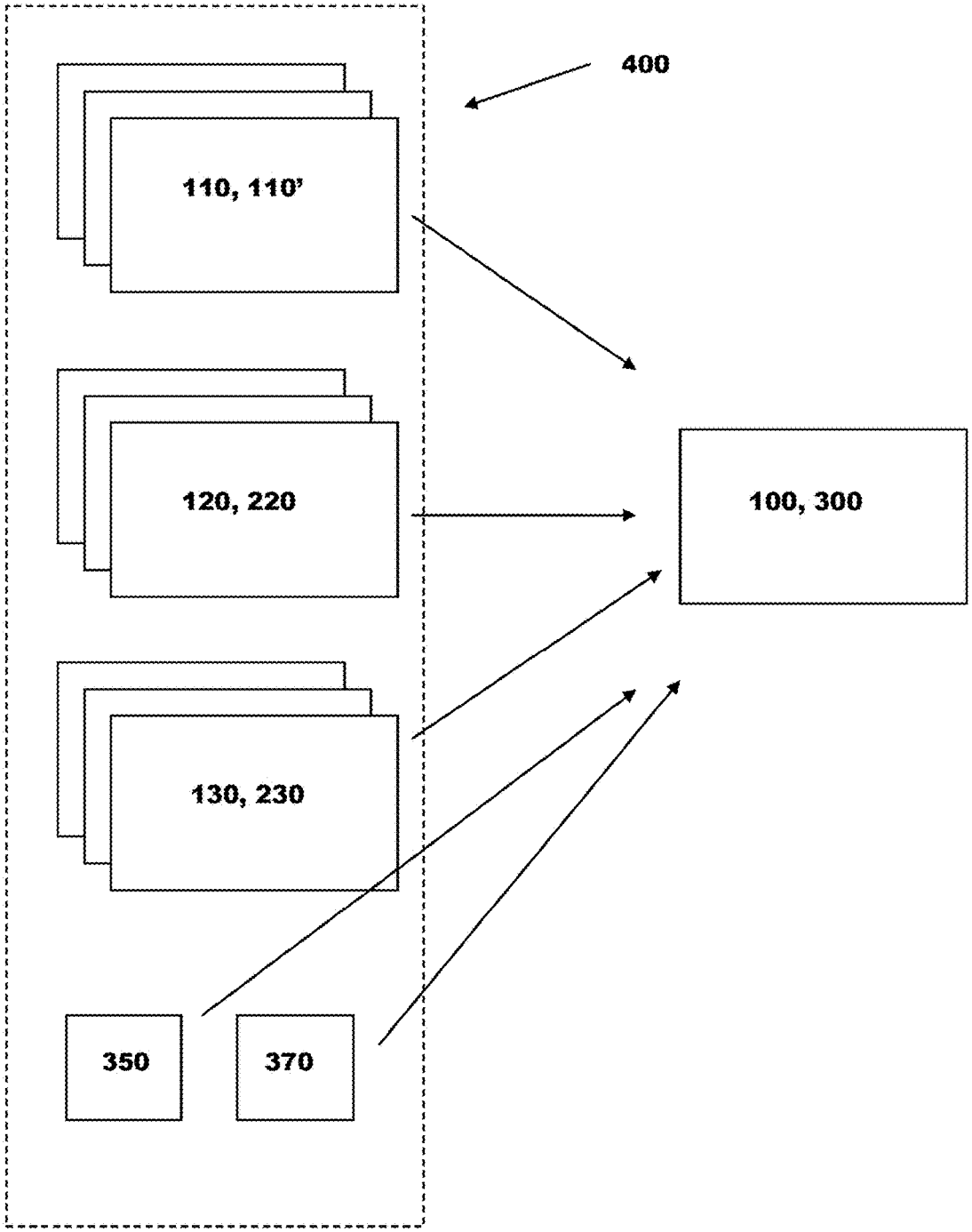
FIG. 14 is a schematic view of a kit for a work platform.

With reference to FIG. 14, the work platform 100, 300 can be provided in a kit 400 that optionally includes one or more versions of a top member 110, 110', optionally includes one or more versions of a bottom member 120, 220, and optionally includes one or more versions of bumpers 130, 230. In one embodiment, the kit 400 can include just one component (e.g., one top member, or one top bottom member, or one bumper), and optionally include instructions for installing and using said component. In other embodiments, the kit 400 can include more than one component, whether of the same type (e.g., multiple top members), or of different types (e.g., a top member and a bottom member). For example, the kit 400 can include multiple bottom members 220, each made of a different material (e.g., plastic, metal) or having a different color. Similarly, the kit can optionally include multiple top members 110, each made of a different material (e.g., a single layer of plywood; a combination of a foam layer and a rigid layer, such as plywood; steel; carpet; AstroTurf®, etc.), thereby providing a variety of combinations for the work platform. Accordingly, the work platform 100, 300 is modular with the top member 110, 110', bottom member 120, 220 and bumpers 130, 230 having different versions (e.g., of material, color, design, texture, comfort, grip, adjustable instability) that are interchangeable, allowing the user to customize their work platform 100, 300 as desired based on their preferences (e.g., using a top member 110, 110' that is more or less cushioned) by interchanging the various components. In some embodiments, a portion of the top member 110, 110', not the entire top member, is interchangeable; for example, the top member 110, 110' can have two or more layers, wherein only one of the layers is interchangeable. Similarly, in some embodiments a portion of the bottom member 120, 220, not the entire bottom member, is interchangeable; for example, the bottom member 120, 220 can have two or more layers, wherein only one of the layers is interchangeable. The kit 400 can be packaged and sold separately from the work platform 100, 300, to allow the user to customize the work platform 100, 300 with the one or more components included in the kit 400. The kit 400 can optionally include instructions for replacing one or more components in the work platform 100, 300 with one or more components included in the kit 400.

Optionally, the work platform 100, 300 can be used with a mat 350, which may optionally be included as part of the kit 400 discussed above. The mat 350 can in one embodiment have dimensions that generally correspond to the dimensions of the work platform 100, 300. In other embodiments, the mat 350 can be smaller than the work platform 100, 300. In other embodiments, the mat 350 can be larger than the work platform 100, 300. The mat 350 can advantageously provide cushioned support to the work platform 100, 300. The mat 350 can also inhibit (e.g., prevent) damage to a floor or work platform 100, 300 during use of the work platform 100, 300.

Optionally, the work platform 100, 300 can have a support 370 (e.g., similar to a docking station) that can hold the work platform 100, 300 (e.g., in a fixed position) when not in use. In some embodiments, the support 370 can be placed (e.g., slid) under at least a portion of the work platform 100, 300. In another embodiment, the support 370 can be an actuatable support, like a kickstand, which can be attached (e.g., fixedly attached, removably attached) to a portion of the work platform 100, 300. The support 370 may optionally be included in the kit 400 discussed above.

One of skill in the art will recognize that while the devices described herein are referred to as work platforms for use in a work environment, they can also be described as balance boards that can be used in other environments (e.g., therapy, fitness), and the scope of the invention is not limited by the way these devices are used.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A platform that supports a user while at a standing workstation, comprising:

a top member configured for a user to stand upon having a perimeter with a length greater than a width and continuous outer boundary; and a bottom member disposed at least partially beneath the top member, the bottom member having a perimeter with a length greater than a width, the perimeter of the bottom member circumscribing the perimeter of the top member so that the perimeter of the top member is adjacent the perimeter of the bottom member along an entirety of the perimeter of the top member, the bottom member configured to allow multi-axial movement of the platform and having a functional tilt limit angle from a neutral position of 18 degrees or less in a widthwise direction of the platform, a bulb portion having a first curvature located generally at the center of the bottom member such that the bulb portion continuously and gradually contacts a support surface on which the platform rests during pivoting of the platform, the bottom member having a plurality of cutouts arranged around the bulb portion, a bumper disposed at each of four corners of the bottom member, wherein the platform has a fixed height between a top surface of the top member and a bottommost point of the bottom member of between about 1 inches and about 3 inches when the platform is in the neutral position, the platform configured to induce multi-axial movement by the user while standing on the work platform at a standing workstation.

2. The platform of claim 1, wherein side edges of the bottom member are located laterally inward of an outer side edge of the platform and vertically downward from a top edge of the bottom member.

3. The platform of claim 1, wherein the side edges are spaced a distance from the top surface so as to define a tilt limit angle from the neutral position of about 16 degrees or less in the widthwise direction of the platform.

4. The platform of claim 3, wherein the tilt limit angle from the neutral position is about 15 degrees or less in the widthwise direction of the platform.

5. The platform of claim 3, wherein the bottom member defines a tilt limit angle in a lengthwise direction of the platform from the neutral position of about 10 degrees.

6. The platform of claim 1, wherein at least a portion of the bulb portion is defined by a spherical surface.

7. The platform of claim 1, wherein a shape of the bottom surface in a lengthwise direction transitions from generally flat ends to the bulb portion via a concave surface interposed between the flat ends and the bulb portion.

8. The platform of claim 2, wherein a height of the side edges from a top edge of the bottom member gradually decreases toward the ends of the platform.

9. The platform of claim 1, wherein the top surface is interchangeable.

10. A platform that supports a user while at a standing workstation, comprising:

a top member for a user to stand upon and having a perimeter with a length greater than a width and continuous outer boundary; and a bottom member having a perimeter with a length greater than a width and that allows multi-axial movement of the platform, the perimeter of the bottom member circumscribing the perimeter of the top member so that the perimeter of the top member is adjacent the perimeter of the bottom member along an entirety of the perimeter of the top member, the bottom member defined by a single piece and comprising a bulb portion generally at a center of the bottom member so that the bulb portion continuously and gradually contacts a support surface during pivoting of the platform, the bottom member having a functional tilt limit angle from a neutral position of 18 degrees or less in a widthwise direction of the platform and a plurality of cutouts arranged around the bulb portion, a bumper disposed at each of four corners of the bottom member, wherein the platform has a fixed height between a top surface of the top member and a bottommost point of the bottom member of between about 1 inches and about 3 inches when the platform is in the neutral position, the platform configured to induce multi-axial movement by the user while standing on the work platform at a standing workstation.

11. The platform of claim 10, wherein the tilt limit angle is about 16 degrees or less in the widthwise direction.

12. The platform of claim 10, wherein the bottom surface defines a tilt limit angle in a lengthwise direction of the platform from the neutral position of about 10 degrees.

13. The platform of claim 10, wherein the bulb portion is defined by a spherical surface having a first radius of curvature.

14. The platform of claim 10, wherein a shape of the bottom member in a lengthwise direction transitions from generally flat ends to the bulb portion via a concave surface interposed between the flat ends and the bulb portion.

* * * * *